US009306270B2

(12) United States Patent
Schmidt et al.

(10) Patent No.: US 9,306,270 B2
(45) Date of Patent: Apr. 5, 2016

(54) ANTENNA ARRAY AND METHOD FOR OPERATING ANTENNA ARRAY

(75) Inventors: Georg Schmidt, Laichingen (DE); Martin Weckerle, Ulm (DE)

(73) Assignee: KATHREIN-WERKE KG, Rosenheim (DE)

( * ) Notice: Subject to any disclaimer, the term of this patent is extended or adjusted under 35 U.S.C. 154(b) by 244 days.

(21) Appl. No.: 13/016,440

(22) Filed: Jan. 28, 2011

(65) Prior Publication Data

US 2012/0194385 A1 Aug. 2, 2012

(51) Int. Cl.

| | |
|---|---|
| ***H01Q 1/24*** | (2006.01) |
| ***H01Q 3/28*** | (2006.01) |
| ***H01Q 21/06*** | (2006.01) |
| ***H01Q 25/00*** | (2006.01) |

(52) U.S. Cl.
CPC ..... *H01Q 1/246* (2013.01); *H01Q 3/28* (2013.01); *H01Q 21/06* (2013.01); *H01Q 25/00* (2013.01)

(58) Field of Classification Search
CPC ..... H01Q 3/30; H01Q 1/246; H01Q 21/06; H01Q 25/00; H01Q 3/28
USPC ..... 342/368–377
See application file for complete search history.

(56) References Cited

U.S. PATENT DOCUMENTS

| | | | | |
|---|---|---|---|---|
| 4,257,050 | A * | 3/1981 | Ploussios | 342/372 |
| 5,546,095 | A * | 8/1996 | Lopez | 343/703 |
| 6,307,507 | B1 * | 10/2001 | Gross et al. | 342/373 |
| 6,336,033 | B1 * | 1/2002 | Yamaguchi et al. | 455/273 |
| 6,504,516 | B1 * | 1/2003 | Davis | 343/853 |
| 2006/0038738 | A1 * | 2/2006 | Shtrom | H01Q 3/24 343/876 |
| 2010/0060517 | A1 | 3/2010 | Nichols et al. | |

* cited by examiner

*Primary Examiner* — Cassie Galt
(74) *Attorney, Agent, or Firm* — Stephen H. Eland; Dann, Dorfman, Herrell & Skillman

(57) ABSTRACT

The present invention refers to an active antenna array having a plurality of antenna elements comprising: at least one first subset of the plurality of antenna elements, the at least one first subset relaying a first radio signal having a first antenna beam pattern; and at least one second subset of the plurality of antenna elements, the at least one second subset relaying a second radio signal having a second antenna beam pattern, wherein at least one of the plurality of antenna elements is a common antenna element belonging to both the first subset and the second subset. A method for operating the active antenna array is also disclosed.

17 Claims, 6 Drawing Sheets

ANTENNA ARRAY AND METHOD FOR OPERATING ANTENNA ARRAY

CROSS-REFERENCE TO RELATED APPLICATION

None

FIELD OF THE INVENTION

The field of the invention relates to an antenna array and a method for operating such an antenna array.

BACKGROUND OF THE INVENTION

The use of mobile communications networks has increased over the last decade. Operators of the mobile communications networks have increased the number of base transceiver stations in order to meet an increased demand for service by users of the mobile communications networks. The operators of the mobile communications network wish to reduce the running costs of the base transceiver station.

Nowadays active antenna arrays are used in the field of mobile communications systems in order to reduce power transmitted to a handset of a customer and thereby increase the efficiency of the base transceiver station, i.e. the radio station. The radio station typically comprises a plurality of antenna elements, i.e. an antenna array adapted for transceiving a payload signal. Typically the radio station comprises a plurality of transmit paths and receive paths. Each of the transmit paths and receive paths are terminated by one of the antenna elements. The plurality of the antenna elements used in the radio station typically allows steering of a beam transmitted by the antenna array. The steering of the beam includes but is not limited to at least one of: detection of direction of arrival (DOA), beam forming, down tilting and beam diversity. These techniques of beam steering are well-known in the art.

The active antenna arrays typically used in the mobile communications network are uniform linear arrays comprising a vertical column of pairs of antenna array elements. The active antenna array or active antenna system is typically mounted on a mast or tower. The active antenna array is coupled to the base transceiver station (BTS) by means of a fibre optics cable and a power cable. The base transceiver station is coupled to a fixed line telecommunications network operated by one or more operators.

Equipment at the base of the mast as well as the active antenna array mounted on the mast is configured to transmit and receive radio signal within limits set by communication standards.

The code sharing and time division strategies as well as the beam steering rely on the radio station and the active antenna array to transmit and receive within limits set by communication standards. The communications standards typically provide a plurality of channels or frequency bands useable for an uplink communication from the handset to the radio station as well as for a downlink communication from the radio station to the subscriber device.

For example, the communication standard "Global System for Mobile Communications (GSM)" for mobile communications uses different frequencies in different regions. In North America, GSM operates on the primary mobile communication bands 850 MHz and 1900 MHz. In Europe, Middle East and Asia most of the providers use 900 MHz and 1800 MHz bands. Other examples are the UMTS standard or long term evolution (LTE) at 700 MHz (US) or 800 MHz (EU).

As technology evolves, the operators have expressed a desire for an active antenna array which is as cost-effective as possible. The side lobe suppression should be maximized without significant increase of antenna size and cost, and without significantly sacrificing the tilt range of the antenna.

PRIOR ART

FIGS. 1 and 2 show prior art solutions for antenna arrays. The passive antenna array 1000 of FIG. 1 comprises eight antenna elements 1001-1 through 1001-8, which are passively coupled by a passive feed network 1006. A fixed beam pattern may be adjusted by selecting static beam forming weights $v_1$, through $v_8$. In such a prior art passive antenna array, beam up-tilting or down-tilting can be achieved using either mechanical tilting (e.g. using a stepper-motor or servo-motor based system for remotely moving the passive antenna's system tilt angle, by physically moving the whole of the antenna itself) or by using a 'remote electrical tilt' (RET) system. Such a RET system typically utilizes motor-controlled phase shift elements to achieve a tilt of the radio beam formed from the radio signals. The phases of the antenna elements 1001-1 through 1001-8 can thereby be progressively shifted in relation to each other in order to modify the tilt of the antenna array 1000. It should be noted, however, that such a passive feed network 1006 does not allow for dynamic beam shape or tilt adaptations during operation of the antenna array 1000.

FIG. 2 shows a known active antenna array 2000, wherein each of eight antenna elements 2001-1 through 2001-8 is connected to its own transceiver element 2003-1 through 2003-8. The beam shape and tilt can be flexibly designed by dynamically adjusting the beam forming weights $w_1$ through $w_8$ at the respective transceiver elements 2003-1 through 2003-8.

A partitioned aperture array antenna is known from US Patent Application Publication No. 2010/0060517 A1 (Nichols et al.). The antenna array described therein includes a first passively combined sub-array having a first number of antenna elements equipped with transmit functionality and a second passively combined sub-array having a second number of antenna elements equipped with receive functionality, wherein the first number of antenna elements and the second number of antenna elements are not equal to each and the first sub-array and the second sub-array have at least one common antenna element.

It is, however, not desired to have different passively combined sub-arrays with separate transmit functionality and receive functionality. For most communications standards, such as LTE MIMO communications for instance, it is desired to use the same configuration and therefore the same antenna elements for both transmission and reception of radio signals. The antenna array should be able to radiate the radio signals from different carriers with different beam patterns, which may be dynamically modified during operation of the antenna array.

SUMMARY OF THE INVENTION

According to one aspect of the present disclosure, an active antenna array having a plurality of antenna elements is disclosed. The active antenna array comprises at least one first subset of the plurality of antenna elements, the at least one first subset relaying a first radio signal having a first antenna beam pattern, and at least one second subset of the plurality of antenna elements, the at least one second subset relaying a second radio signal having a second antenna beam pattern. At least one of the plurality of antenna elements is a common antenna element belonging to both the first subset and the second subset.

It will be appreciated that there may be more than one first subset of the plurality of antenna elements and more than one second subset of the plurality of antenna elements. In other words, there may be a plurality of subsets of the plurality of antenna elements. There will be at least one common antenna element that is common to two of the plurality of subsets. There may be more than one common antenna element, but each one of plurality of subsets will generally have only a single common antenna element. In other words, there will generally not be two common antenna elements in any one subset of the plurality of antenna elements. Not all of the subsets need include one of the common antenna elements. The skilled person will appreciate further that it would be possible to include two common antenna elements in one subset, but this would lead to a loss of flexibility.

According to another aspect of the present disclosure, a method for operating an active antenna array having a plurality of antenna elements is disclosed. The method comprises relaying a first radio signal having a first antenna beam pattern through a first subset of the plurality of antenna elements, and relaying a second radio signal having a second antenna beam pattern through at least one second subset of the plurality of antenna elements, At least one of the plurality of antenna elements is used as a common antenna element belonging to both the first subset and the second subset.

The term "relaying" as described herein shall be construed as comprising a transmitting by the antenna element or a receiving by the antenna element, or both. The term "relayed power" as described herein shall be construed as comprising a transmitted power or a received power, or both.

DETAILED DESCRIPTION OF THE INVENTION

The invention will now be described on the basis of the drawings. It will be understood that the embodiments and aspects of the invention described herein are only examples and do not limit the protective scope of the claims in any way. The invention is defined by the claims and their equivalents. It will be understood that features of one aspect or embodiment of the invention can be combined with a feature of a different aspect or aspects and/or embodiments of the invention.

The term "base transceiver station (BTS)" in the context of this disclosure includes, but is not limited to, base stations, as known from GSM networks, as well as a node B (known from UMTS/3G networks) or enhanced node B, and similar units used in other mobile communication network.

Figure 3:
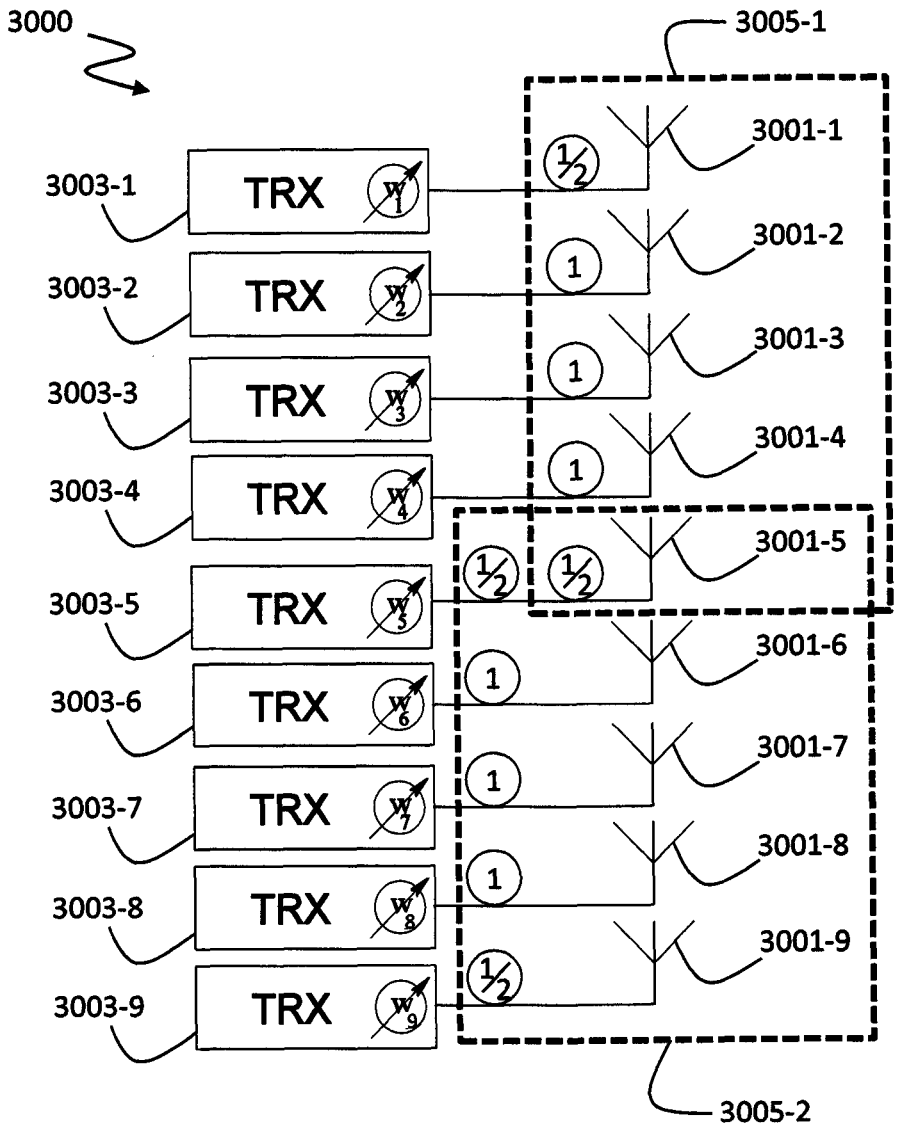
FIG. 3 shows a first example of an active antenna array according to one aspect of the present disclosure.

FIG. 3 shows an active antenna array 3000 according to a first aspect of the present disclosure. The antenna array 3000 comprises a plurality of antenna elements 3001-1 through 3001-9 arranged in a vertical column. It should be noted that the present invention may be directed to an active antenna array 3000 with antenna elements 3001-1 through 3001-9 arranged in a vertical column, but is not restricted to such a vertical arrangement. The antenna elements 3001-1 through 3001-9 may be spaced equidistantly (linearly) or at different spacings (termed non-linearly), vertically or horizontally, in a two-dimensional array or multi-dimensional array, or in any other suitable fashion. It should further be noted that the number of antenna elements 3001-1 through 3001-9 is not limited to nine. There may be any number N of antenna elements 3001-1 through 3001-N in the active antenna array 3000. It will be understood that the choice of the number of antenna elements is important for the optimum power distribution. A specific number of antenna elements needs to be chosen, as will be discussed later (e.g. an unequal number such as 9 for a single element overlapoverap, or an equal number such as 8 for a two element overlap. Otherwise, too much power would be lost.

In the aspect shown in FIG. 3, there is an upper first subset 3005-1 of five active antenna elements 3001-1 through 3001-5 of the plurality of antenna elements 3001-1 through 3001-9. It should be noted that the number of active antenna elements 3001-1 through 3001-5 in the upper first subset 3005-1 is not limited to five. The upper first subset 3005-1 may comprise any number M of the plurality of N antenna elements 3001-1 through 3001-N. As noted above the number M is chosen based on power requirements. The active antenna array 3000 further comprises a plurality of nine transceiver modules 3003-1 through 3003-9, of which the transceiver modules 3003-1 through 3003-5 are associated and actively coupled to the respective active antenna elements 3001-1 through 3001-5 of the upper first subset 3005-1. The upper first subset 3005-1 is configured for relaying a first radio signal having a first antenna beam pattern.

The active antenna array 3000 shown in FIG. 3 also comprises a lower second subset 3005-2 of five active antenna elements 3001-5 through 3001-9 of the plurality of antenna elements 3001-1 through 3001-9. It should be noted that the number of active antenna elements 3001-5 through 3001-9 in the lower second subset 3005-2 is not limited to five. The lower second subset 3005-2 may comprise any number M of the plurality of N antenna elements 3001-1 through 3001-N. Of the plurality of nine transceiver modules 3003-1 through 3003-9, the transceiver modules 3003-5 through 3003-9 are associated and actively coupled to the respective active antenna elements 3001-5 through 3001-9 of the lower second subset 3005-3. The lower second subset 3005-2 is configured for relaying a second radio signal having a second antenna beam pattern. The second antenna beam pattern may differ from the first antenna beam pattern relayed by the upper first subset 3005-1.

The central antenna element 3001-5 is therefore a common antenna element belonging to both the upper first subset 3005-1 and the lower second subset 3005-1. As indicated by the encircled power fractions in FIG. 3, the total radio signal power, which the central antenna element 3001-5 is configured to relay radio signals with, is split up equally in one half of the total radio signal power for relaying the first radio signal and in the other half of the total radio signal power for relaying the second radio signal. The antenna elements 3001-2 through 3001-4 relay the first signal with a total radio signal power, which the respective antenna elements 3001-2 through 3001-4 are configured to relay radio signals with full radio signal power (hence the 1 in a circle). Analogously, the antenna elements 3001-6 through 3001-8 relay the second signal with a full radio signal power, which the respective antenna elements 3001-6 through 3001-8 are configured to relay radio signals with. The total output power of the transceiver element 3003-5 associated with the common antenna element 3001-5 corresponds to the total radio signal power of the common antenna element 3001-5.

In order to achieve a symmetric tapering effect resulting in an enhanced side lobe suppression for both the first and the second antenna beam pattern, some of the antenna elements 3001-1 to 3001-9 of the active antenna array 4000 may be configured to relay radio signals with different radio signal power. To achieve this, the associated transceiver modules 3003-1 to 3003-9 may be configured to change their total output power, as will be discussed below.

It will be understood that it is not just the outermost antenna elements 3001-1 to 3001-9 of the active antenna array 3000 4000 which are involved in tapering, but also the centre antenna element 3001-5. The common antenna element 3001-53005 is in both the upper first subset 3005-1 and the lower second subset 3005-2. The common antenna element 3001-5 is supplied with the same amount of power as the outermost antenna element 3001-1 from the first subset 3005-1 to which is added the same amount of radio signal power supplied to the outermost antenna element 3001-9 from the second subset 3005-1.

Figure 4:
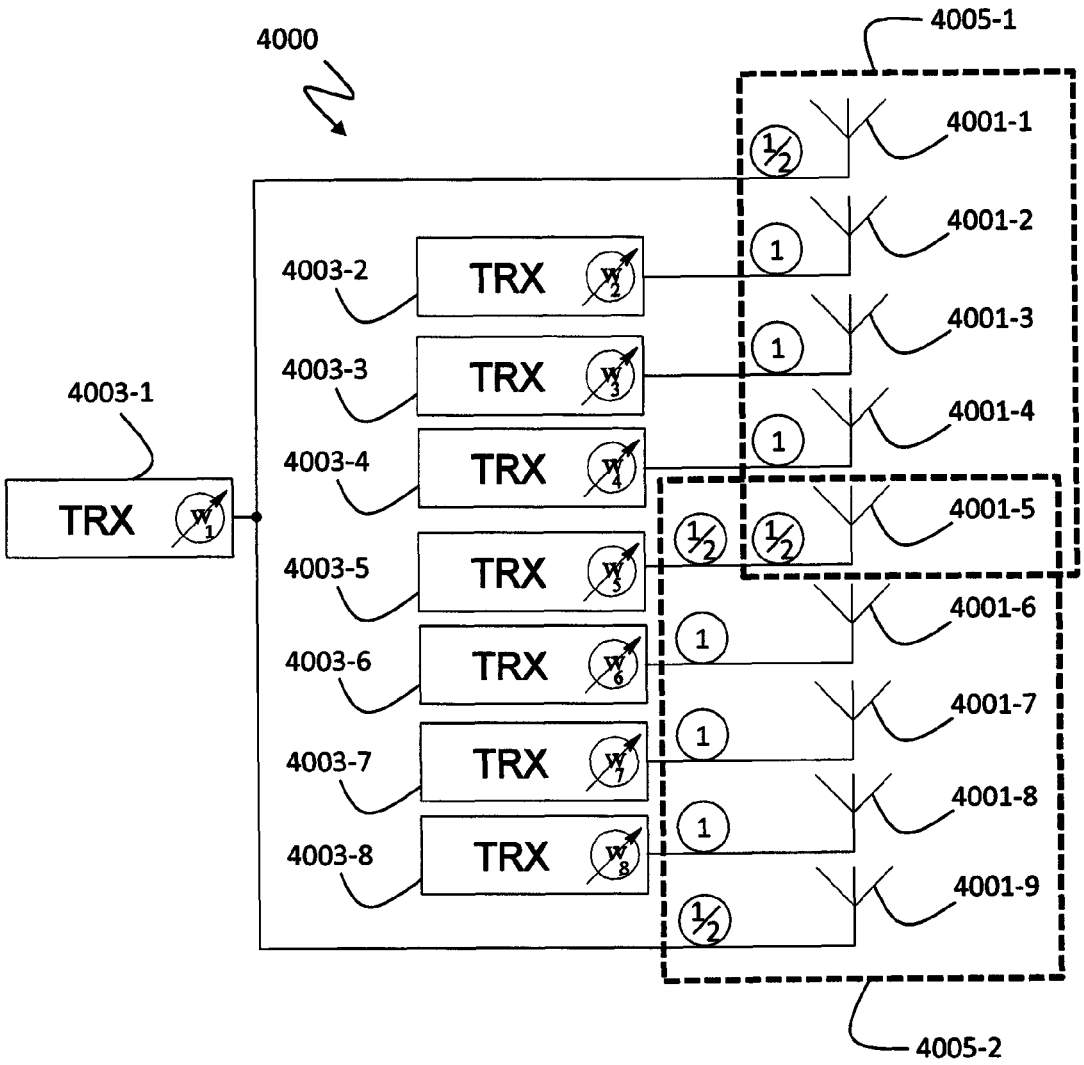
FIG. 4 shows a second example of an active antenna array according to the present disclosure.

FIG. 4 shows an active antenna array 4000 according to a second aspect of the present disclosure. The active antenna array 4000 differs from the one shown in FIG. 3 by the fact that the outermost non-common antenna element 4001-1 of the first subset 3005-1 and the outermost non-common antenna element 3001-9 of the second subset 3005-2 are connected to a common transceiver module 4003-1. Therefore, the total number of transceiver modules is 4003-1 through 4003-8 is reduced by one in comparison with the active antenna array 3000 shown in FIG. 3. The common transceiver module 4003-1 may be operated with a total output power that is equally split up among the connected outermost non-common antenna element 4001-1 of the first subset 4005-1 and the connected outermost non-common antenna element 4001-9 of the second subset 4005-2. In the example in FIG. 4, one transceiver module is saved and the active antenna array 4000 may be operated with maximum overall power efficiency. It will be understood that there is exactly one degree of freedom in choosing the phase of one antenna element per subset. Hence, we can connect exactly one pair of antenna elements in the two sub-arrays without sacrificing tiltability of the first subset 4005-1 and the second subset 4005-2.

At the first glance, it may appear as a significant drawback for beam forming, that the phase of the outermost antenna elements 4001-1 and 8 can only be modified together through the beam forming parameter $w_1$ for the common transceiver module 4003-1. However, since beam forming only relies on phase differences between the antenna elements of the respective subset and not on absolute phases, the example presented in FIG. 4 allows flexible beam forming on both the upper first subset 4005-1 and the lower second subset 4005-2 without loss of flexibility in beam forming or tilt ranges.

Figure 5:
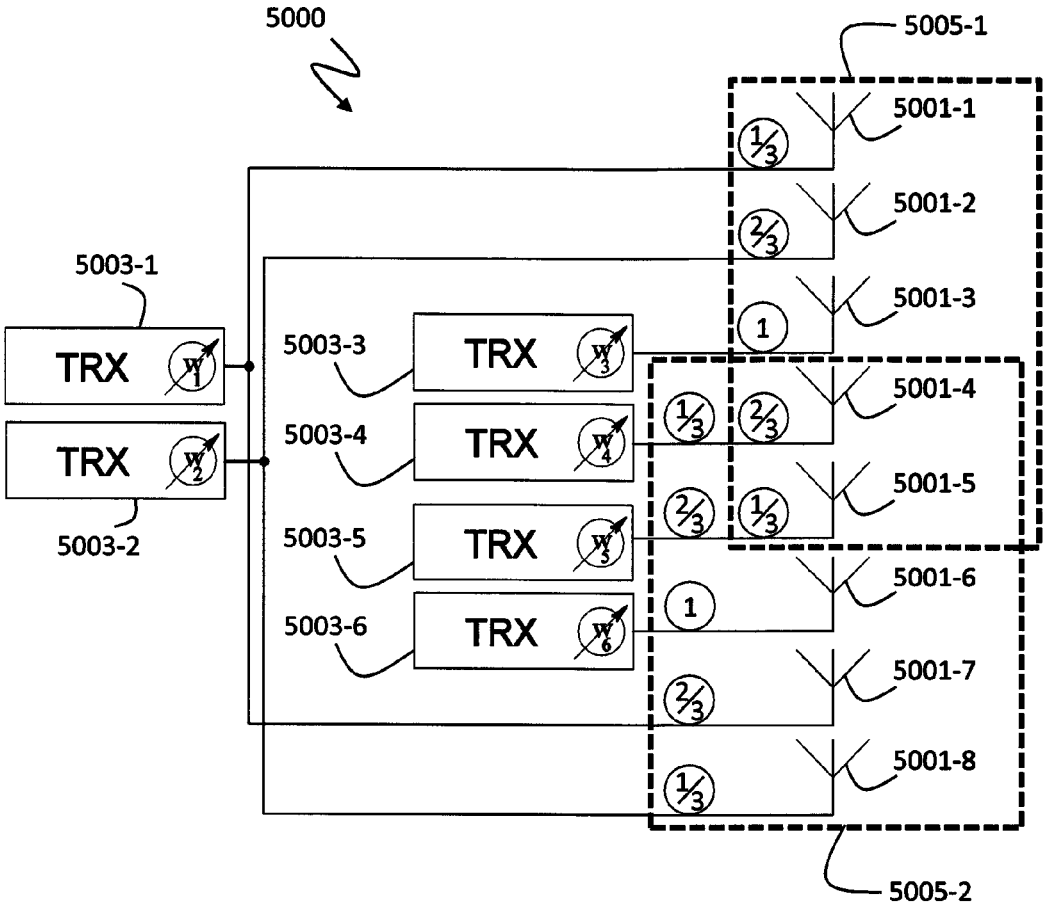
FIG. 5 shows a third example of an active antenna array according to the present disclosure.

FIG. 5 shows an active antenna array 5000 according to a third aspect of the present disclosure. The antenna array 5000 comprises eight antenna elements 5001-1 through 5001-8 arranged in a vertical column. It should be noted that the present invention may be directed to an active antenna array 5000 with antenna elements 5001-1 through 5001-8 arranged in a vertical column, but is not restricted to such a vertical arrangement. The antenna elements 5001-1 through 5001-8 may be arranged linearly or non-linearly, vertically or horizontally, in a two-dimensional array or multi-dimensional array, or in any other suited fashion. It should further be noted that the number of antenna elements 5001-1 through 5001-9 is not limited to eight. There may be any number N of antenna elements 5001-1 through 5001-N in the active antenna array 5000.

In the example shown in FIG. 5, there is an upper first subset 5005-1 of five active antenna elements 5001-1 through 5001-5 of the plurality of antenna elements 5001-1 through 5001-8. It should be noted that the number of active antenna elements 5001-1 through 5001-5 in the upper first subset 5005-1 is not limited to five. The upper first subset 5005-1 may comprise any number M of the plurality of N antenna elements 5001-1 through 5001-N. The upper first subset 5005-1 is configured for relaying a first radio signal having a first antenna beam pattern.

The active antenna array 5000 shown in FIG. 5 also comprises a lower second subset 5005-2 of five active antenna elements 5001-4 through 5001-8 of the plurality of antenna elements 5001-1 through 5001-8. It should be noted that the number of active antenna elements 5001-4 through 5001-8 in the lower second subset 5005-2 is not limited to five. The lower second subset 5005-2 may comprise any number M of the plurality of N antenna elements 5001-1 through 5001-N. The lower second subset 5005-2 is configured for relaying a second radio signal having a second antenna beam pattern. The second antenna beam pattern may differ from the first antenna beam pattern relayed by the upper first subset 5005-1.

The central antenna elements 5001-4 and -5 are therefore common antenna elements belonging to both the upper first subset 5005-1 and the lower second subset 5005-1. As indicated by the encircled power fractions in FIG. 5, the total radio signal power, which the common antenna element 5001-4 is configured to relay radio signals with, is split up unequally in two thirds of the total radio signal power for relaying the first radio signal and in one third of the total radio signal power for relaying the second radio signal. Analogously, the total radio signal power, which the common antenna element 5001-5 is configured to relay radio signals with, is split up unequally in one third of the total radio signal power for relaying the first radio signal and two thirds of the total radio signal power for relaying the second radio signal. The total output power of a transceiver element 5003-4 associated to and connected with the common antenna element 5001-4 corresponds to the total radio signal power of the common antenna element 5001-4. Analogously, the total output power of a transceiver element 5003-5 associated to and connected with the common antenna element 5001-5 corresponds to the total radio signal power of the common antenna element 5001-5.

The antenna element 5001-3 relays the first signal with a total radio signal power, with which the antenna element 5001-3 is configured to relay radio signals. Analogously, the antenna elements 5001-6 relays the second signal with a total radio signal power, with which the antenna element 3001-6 is configured to relay radio signals. The two antenna elements 5001-3 and 6 constitute the central antenna elements of the upper first subset 5005-1 and the lower second subset 5005-2, respectively.

In order to achieve a symmetric tapering effect resulting in an enhanced side lobe suppression for both the first antenna beam pattern and the second antenna beam pattern, the outermost antenna elements 5001-1,2 and 5001-7,8 of the active antenna array 5000 may be configured to relay with reduced radio signal power. For the upper first subset 5001-1, the outermost antenna element 5001-1 may be configured to relay the first radio signal with only one third of its total radio signal power. The second outermost antenna element 5001-2 of the upper first subset 5005-1 may be configured to relay the first radio signal with only two thirds of its total radio signal power. Thereby, a symmetric tapering effect is achieved for the first antenna beam pattern. Analogously, for the lower second subset 5001-2, the outermost antenna element 5001-8 may be configured to relay the second radio signal with only one third of its total radio signal power. The second outermost antenna element 5001-7 of the lower second subset 5005-2 may be configured to relay the second radio signal with only two thirds of its total radio signal power. Thereby, a symmetric tapering effect is achieved for the second antenna beam pattern. If each of the outermost antenna elements 5001-1,2 and 5001-7,8 was connected to its own associated transceiver module, the associated transceiver modules could be configured to reduce their total output power accordingly (analogous to FIG. 3).

However, similarly to the active antenna array 4000 shown in FIG. 4, the power efficiency can be by further increased by having two shared antenna elements 5001-4 and 5001-5 in the active antenna array 5000. One of the transceiver modules 5003-1 is connected to both a non-common antenna element 5001-2 in the first subset 5005-1 and to another non-common element 5001-8 in the second subset 5005-2. Therefore, the total number of transceiver modules is 5003-1 through 5003-7 is also reduced by one in comparison with the prior art active antenna array 2000 shown in FIG. 2. The outermost non-common antenna element 5001-1 of the first subset 5005-1, relays one third of its total radio signal power which means that the second transceiver module 5003-2 is operating at reduced power. The second-outermost non-common antenna element 5001-7 of the second subset 5005-2, relays with two thirds of its total radio signal power which means that the seventh transceiver module 5003-7 is also operating at reduced power. The second-outermost non-common antenna element 5001-2 of the first subset 5001-1, relaying with two thirds of its total radio signal power, and the outermost non-common antenna element 5001-8 of the second subset 5005-2, relaying with one third of its total radio signal power, are connected to the first common transceiver module 5003-1.

The fourthforth transceiver module 5003-4 is connected to the fourthforth common element 5001-4 and supplies one third of the radio power for radio signals transmitted from the first subset 5005-1 as well as one third of the power for radio signals transmitted from the second subset 5005-2. The fifth transceiver module 5003-5 is connected to the fifth common antenna element 5001-5 which transmits one third of the power of the radio signals from the first subsets 5005-1 and two thirds of the power of the radio signals from the second subset 5005-2.

Figure 1:
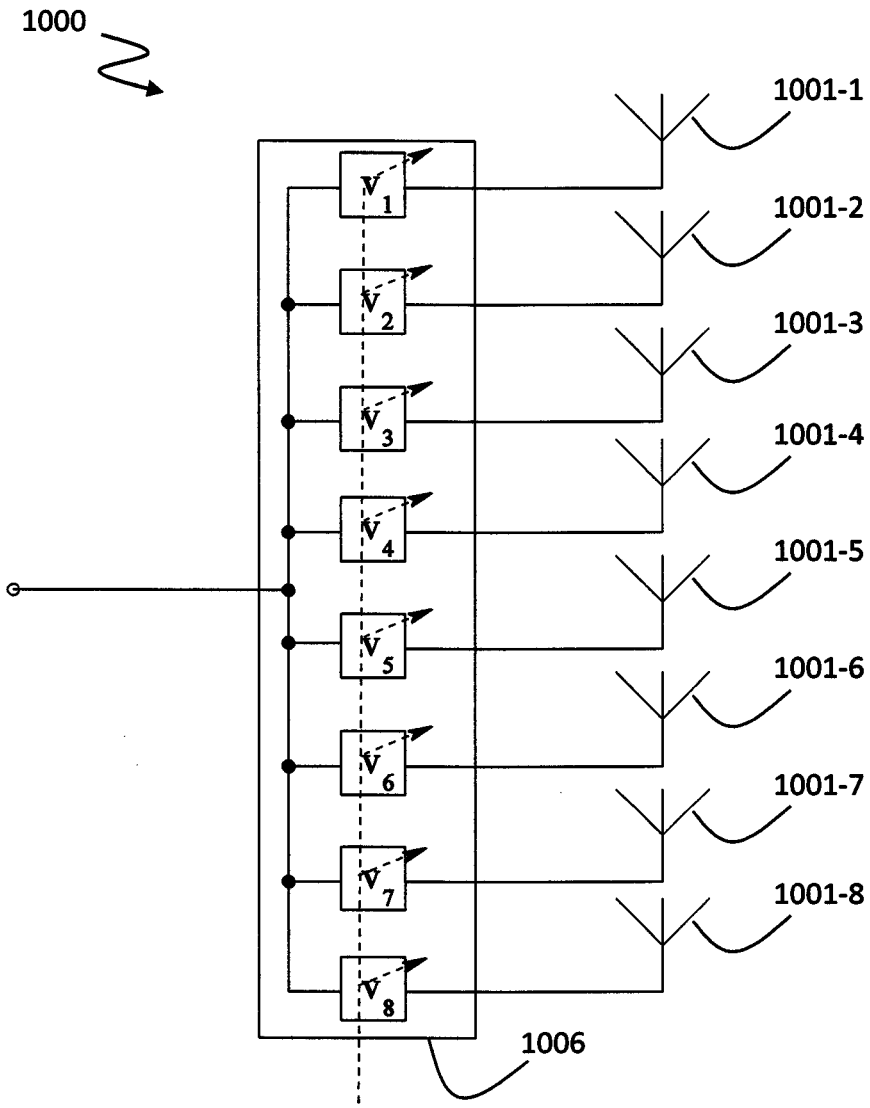
Fig. 1 Prior Art
FIG. 1 shows a prior art passive antenna array.
Figure 2:
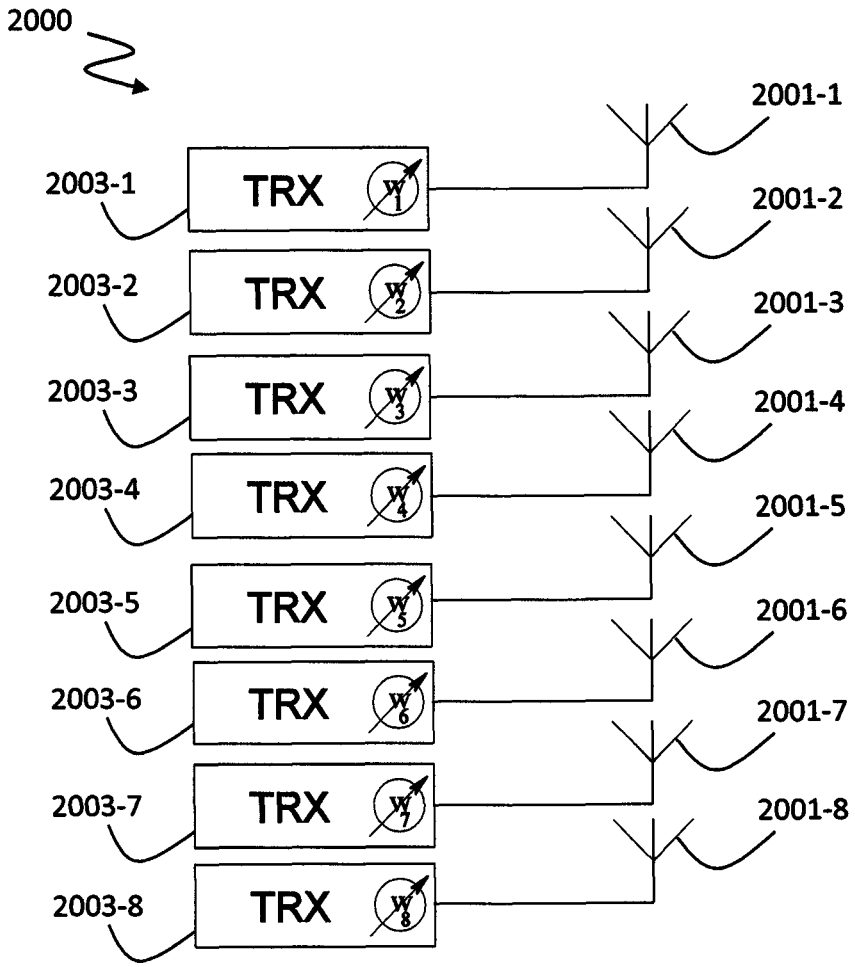
Fig. 2 Prior Art
FIG. 2 shows a prior art active antenna array.

In the example in FIG. 5, one transceiver module is saved with respect to the prior art antenna array 2000 shown in FIG. 2 while the active antenna array 5000 may be operated with power efficiency, as neither the first transceiver module 5003-1 nor the seventh transceiver module 5003-7 operate at full power.

Again, at the first glance, it may appear as a significant drawback for beam forming, that the phase of the antenna elements 5001-1,7 and 5001-2,8 can only be modified together through the beam forming parameters $w_1$ and $w_2$ for the common transceiver modules 4003-1,2. However, since beam forming only relies on phase differences between the antenna elements of the respective subset and not on absolute phases, the example presented in FIG. 5 allows flexible beam forming on both the upper first subset 5005-1 and the lower second subset 5005-2 without loss of flexibility in beam forming or tilt ranges.

Figure 6A:
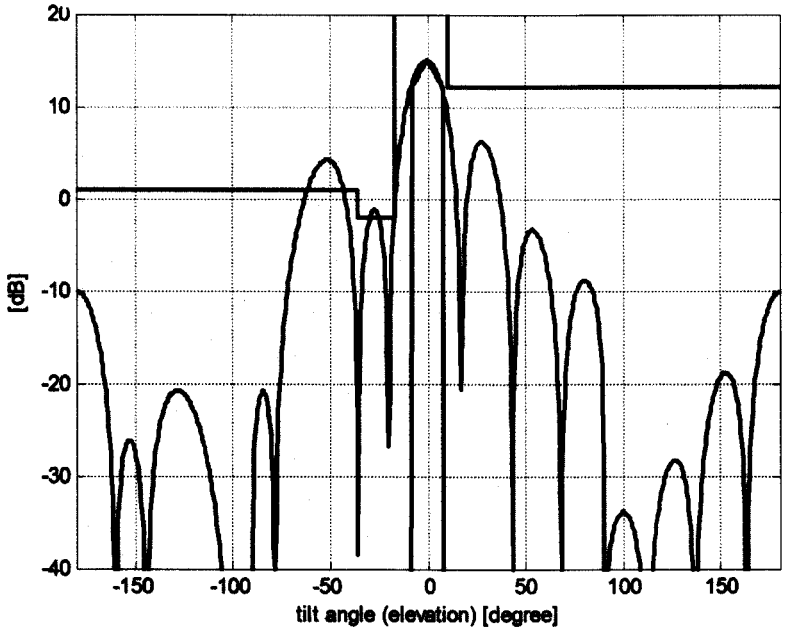
FIG. 6*a* shows an overall antenna pattern of an eight elements active antenna array with two disjoint subsets of four active antenna elements each.
Figure 6B:
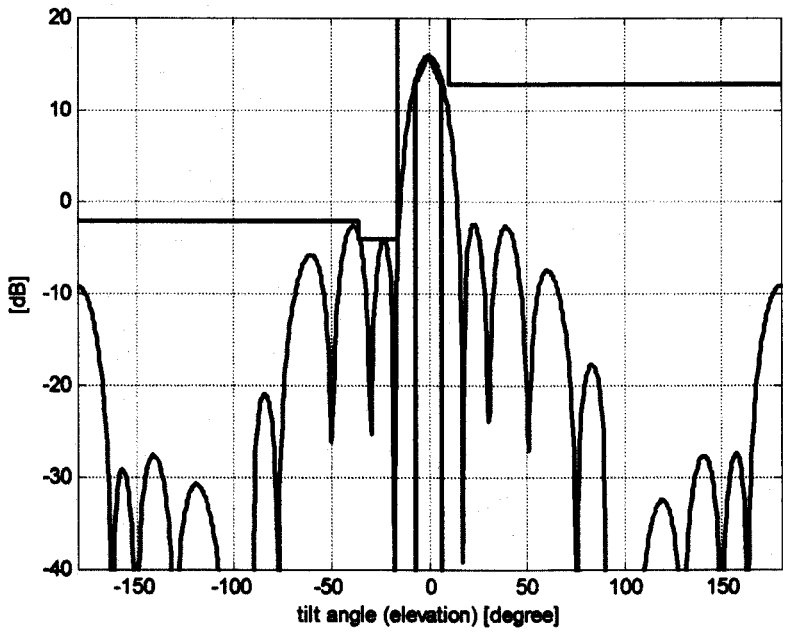
FIG. 6*b* shows an overall antenna pattern of the eight elements active antenna array of FIG. 5.

FIG. 6*a* shows an overall beam pattern of an eight elements antenna array which comprises two disjoint subsets, e.g. an upper first subset comprising the upper four elements and a lower second subset comprising the lower four elements. Here, all eight antenna elements relay with their full total radio signal power. In comparison, FIG. 6*b* shows an overall beam pattern of the active antenna array 5000 shown in FIG. 5. It can be seen that the antenna gain in the main lobe direction is higher by about 0.9 dB in FIG. 6*b*, although the two outermost antenna elements 5001-1,2 and 5001-7,8 do not relay with their full total radio signal power. The side lobe suppression in FIG. 6*b* is enhanced by the tapering effect. The overall loss in effective isotropically radiated power (EIRP) is only in the order of 0.36 dBm, which may be compensated by a slight increase of the power rating of the transceiver modules 5003-1 through 5003-6. However, the active antenna array 5000 shown in FIG. 5 saves two transceiver modules for operating eight antenna elements.

While various embodiments of the present invention have been described above, it should be understood that they have been presented by way of example, and not limitation. It will be apparent to persons skilled in the relevant arts that various changes in form and detail can be made therein without departing from the scope of the invention. In addition to using hardware (e.g., within or coupled to a central processing unit ("CPU"), micro processor, micro controller, digital signal processor, processor core, system on chip ("SOC") or any other device), implementations may also be embodied in software (e.g. computer readable code, program code, and/or instructions disposed in any form, such as source, object or machine language) disposed for example in a computer useable (e.g. readable) medium configured to store the software. Such software can enable, for example, the function, fabrication, modelling, simulation, description and/or testing of the apparatus and methods describe herein. For example, this can be accomplished through the use of general program languages (e.g., C, C++), hardware description languages (HDL) including Verilog HDL, VHDL, and so on, or other available programs. Such software can be disposed in any known computer useable medium such as semiconductor, magnetic disc, or optical disc (e.g., CD-ROM, DVD-ROM, etc.). The software can also be disposed as a computer data signal embodied in a computer useable (e.g. readable) transmission medium (e.g., carrier wave or any other medium including digital, optical, analogue-based medium). Embodiments of the present invention may include methods of providing the apparatus described herein by providing software describing the apparatus and subsequently transmitting the software as a computer data signal over a communication network including the internet and intranets.

It is understood that the apparatus and method describe herein may be included in a semiconductor intellectual property core, such as a micro processor core (e.g., embodied in HDL) and transformed to hardware in the production of integrated circuits. Additionally, the apparatus and methods described herein may be embodied as a combination of hardware and software. Thus, the present invention should not be limited by any of the above-described exemplary embodiments, but should be defined only in accordance with the following claims and their equivalents.

The invention claimed is:

1. An active antenna array having a plurality of antenna elements comprising:

at least one first subset of the plurality of antenna elements, the at least one first subset relaying a first radio signal having a first antenna beam pattern; and at least one second subset of the plurality of antenna elements, the at least one second subset relaying a second radio signal having a second antenna beam pattern, wherein one of the plurality of antenna elements is a common antenna element belonging to both the at least one first subset and the at least one second subset, and wherein a non-common antenna element of the at least one first subset and a non-common antenna element of the at least one second subset are connected to one common transceiver module feeding power to the non-common antenna elements, and wherein the common antenna element is connected to a second transceiver module;

wherein a total output power of said one common transceiver module is split up into a first radio signal power of the first signal relayed through the non-common antenna element of the at least one first subset and a second radio signal power of the second signal relayed through the non-common antenna element of the at least one second subset.

2. The active antenna array of claim 1, said common antenna element being adapted to relay with a total radio signal power that is split up into a first radio signal power of the first radio signal and a second radio signal power of the second radio signal.

3. The active antenna array of claim 2, wherein the total radio signal power is split up unequally between different ones of the plurality of antenna elements.

4. The active antenna array of claim 1, wherein the total output power of said one common transceiver module is split up unequally.

5. The active antenna array of claim 1, wherein the non-common antenna element of the at least one first subset is that antenna element of the at least one first subset which is furthest away from the common antenna element.

6. The active antenna array of claim 1, wherein the non-common antenna element of the at least one second subset is that antenna element of the at least one second subset which is furthest away from the common antenna element.

7. A method for operating an active antenna array having a plurality of antenna elements, the method comprising:

relaying a first radio signal having a first antenna beam pattern through at least one first subset of the plurality of antenna elements; and relaying a second radio signal having a second antenna beam pattern through at least one second subset of the plurality of antenna elements, wherein one of the plurality of antenna elements is used as a common antenna element belonging to both the at least one first subset and the at least one second subset, and wherein further the first signal relayed through a non-common antenna element of the at least one first subset and the second signal relayed through a non-common antenna element of the at least one second subset are processed in one common transceiver module feeding power to the non-common antenna elements, and wherein the first signal and the second signal relayed through the common antenna element are processed in a second transceiver module.

8. The method of claim 7, further comprising relaying through said common antenna element a total radio signal power that is split up into a first radio signal power of the first signal and a second radio signal power of the second signal.

9. The method of claim 8, wherein the total radio signal power is split up unequally.

10. The method of claim 8, further comprising splitting up a total output power of said one common transceiver module into a first radio signal power of the first signal relayed through the non-common antenna element of the at least one first subset and a second radio signal power of the second signal relayed through the non-common antenna element of the at least one second subset.

11. The method of claim 10, wherein the total output power of said one common transceiver module is split up unequally.

12. The method of claim 10, wherein the first signal is relayed with the first radio signal power through the non-common antenna element of the at least one first subset that is furthest away from the common antenna element.

13. The method of claim 10, wherein the second signal is relayed with the second radio signal power through the non-common antenna element of the second subset that is furthest away from the at least one common antenna element.

14. A computer program product embodied on a non-transitory computer-readable medium and the computer-readable medium comprising executable instructions for causing an active antenna array having a plurality of antenna elements to:

a. relaying a first radio signal having a first antenna beam pattern through at least one first subset of the plurality of antenna elements; and b. relaying a second radio signal having a second antenna beam pattern through at least one second subset of the plurality of antenna elements, wherein one of the plurality of antenna elements is used as a common antenna element belonging to both the at least one first subset and the at least one second subset, and wherein further the first signal relayed through a non-common antenna element of the at least one first subset and the second signal relayed through a non-common antenna element of the at least one second subset are processed in one common transceiver module feeding power to the non-common antenna elements, and wherein the first signal and the second signal relayed through the common antenna element are processed in a second transceiver module.

15. The active antenna array of claim 1, wherein the at least one first subset is arranged in an upper vertical column and the at least one second subset is arranged in a lower vertical column, and wherein the upper vertical column and the lower vertical column overlap by said common antenna element.

16. The method of claim 7, wherein relaying the first radio signal through the at least one first subset comprises relaying the first radio signal through an upper vertical column of antenna elements; and relaying the second radio signal through the at least one second subset comprises relaying the second radio signal through an lower vertical column of antenna elements;

wherein the upper vertical column and the lower vertical column overlap by said common antenna element.

17. The active antenna array of claim 1, wherein the at least one first subset is arranged in an upper vertical column and the at least one second subset is arranged in a lower vertical column, and wherein the upper vertical column and the lower vertical column overlap by said common antenna element.

* * * * *